US006312146B1

(12) United States Patent
Tognacci

(10) Patent No.: US 6,312,146 B1
(45) Date of Patent: Nov. 6, 2001

(54) SYSTEM FOR HANGING A LAMP

(76) Inventor: Robert Tognacci, 3728 Georgia Ave. Suite 2B, West Palm Beach, FL (US) 33405

( * ) Notice: Subject to any disclaimer, the term of this patent is extended or adjusted under 35 U.S.C. 154(b) by 0 days.

(21) Appl. No.: 09/497,261

(22) Filed: Feb. 3, 2000

(51) Int. Cl.[7] ..... F21V 21/16

(52) U.S. Cl. ..... 362/407; 362/147; 362/404; 248/324; 248/343; 248/344

(58) Field of Search ..... 362/407, 147, 362/404; 248/344, 343, 324

(56) References Cited

U.S. PATENT DOCUMENTS

| | | | | |
|---|---|---|---|---|
| 2,329,243 | * | 9/1943 | Biller | 248/343 |
| 2,943,137 | * | 6/1960 | Van Wyngarden | 248/343 |
| 4,234,916 | * | 11/1980 | Goralnik | 362/404 |
| 5,515,252 | * | 5/1996 | Osteen et al. | 248/343 |
| 5,522,577 | * | 6/1996 | Roesch | 362/343 |
| 5,613,832 | * | 3/1997 | Su | 248/343 |
| 5,653,412 | * | 8/1997 | Martorano | 248/343 |
| 5,678,799 | * | 10/1997 | Jorgensen et al. | 248/343 |

* cited by examiner

*Primary Examiner*—Sandra O'Shea
*Assistant Examiner*—Guiyoung Lee

(57) ABSTRACT

A system for hanging a lamp at any of a plurality of locations includes an electrical box positioned at a fixed location in a ceiling. A mounting plate has an exterior periphery with a circular central aperture there through and with holes adapted to the periphery and screws extending there through. A slip plate has a large exterior diameter greater than the diameter of the mounting plate. The slip plate is formed with a slot along the majority of one diametric extent. A small washer located between the slip plate and the mounting plate has a central aperture there through essentially equal to the diameter of the central aperture of the mounting plate and the width of the slot. A flanged cylinder has a cylindrical central extent, a central bore, a flanged interior upper end located above and in contact with the mounting plate, and a flanged exterior end in contact with the slip plate. A medallion cover has an exterior diameter greater than that of the slip plate and is positionable in contact with the ceiling.

5 Claims, 3 Drawing Sheets

FIG 3
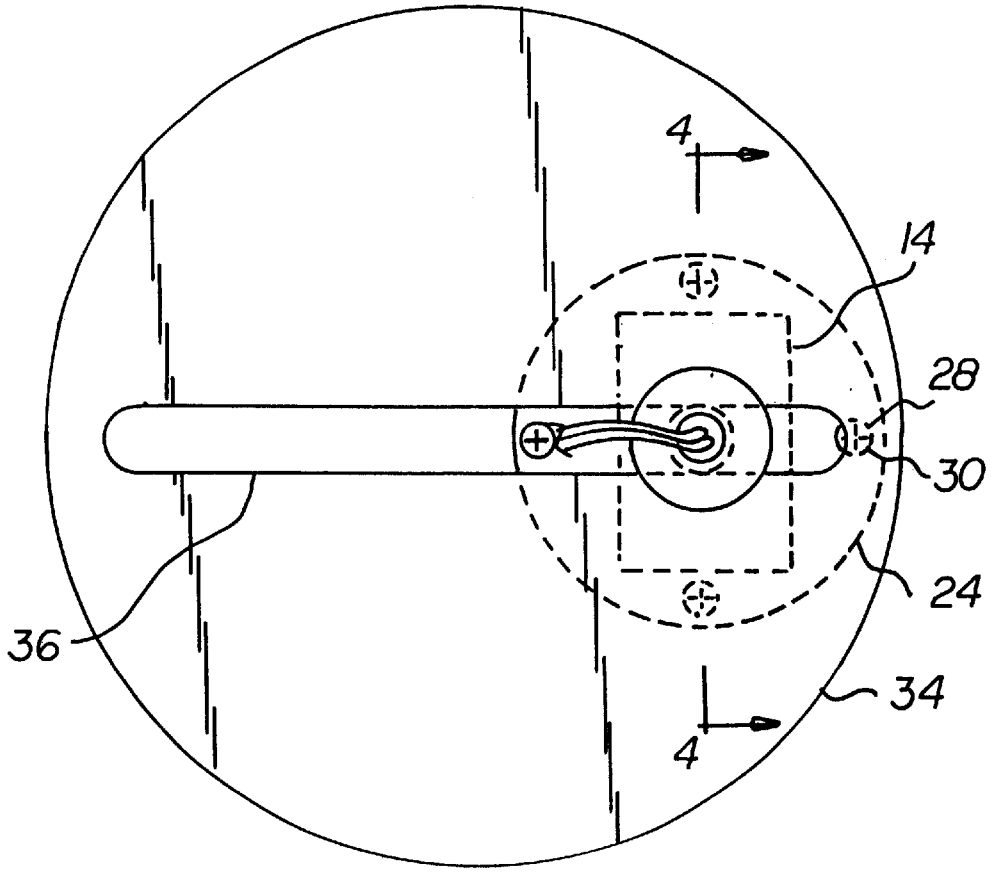
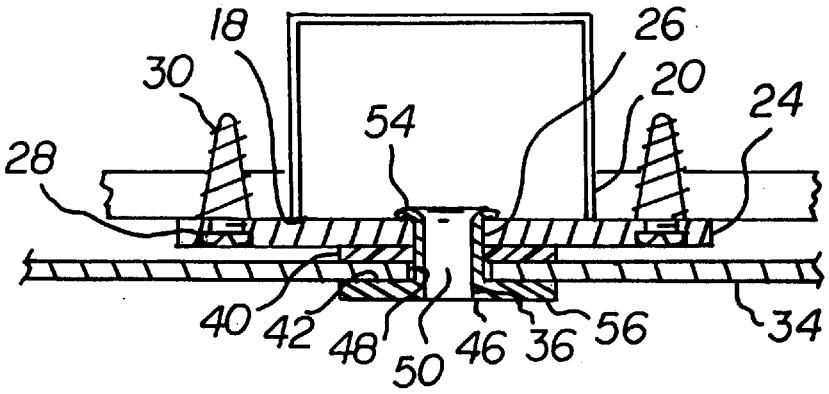
FIG 4

FIG 5
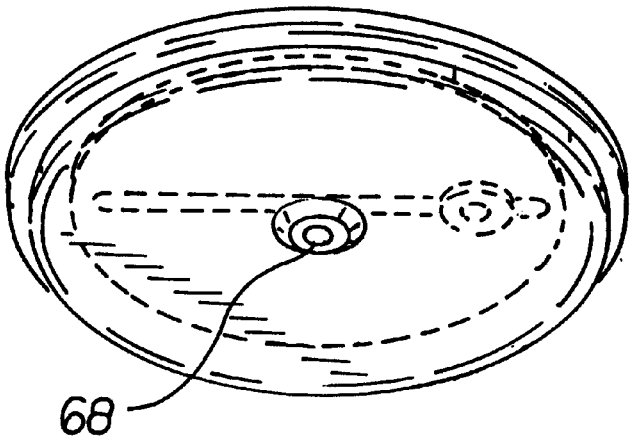
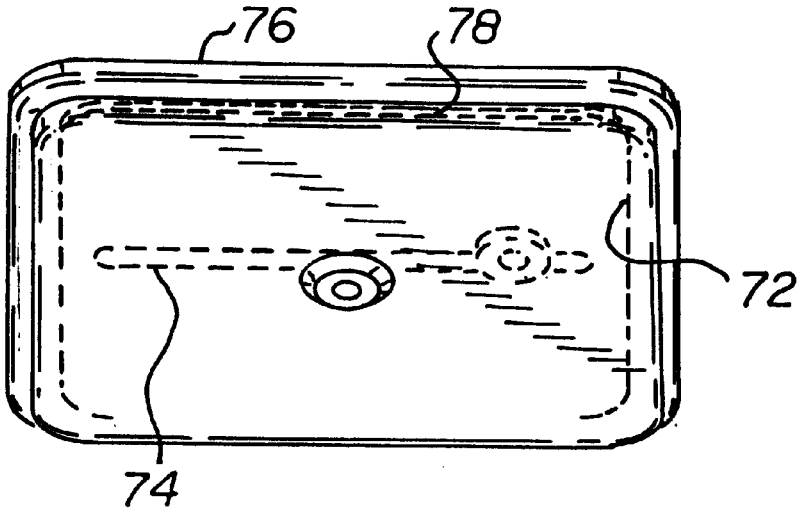
FIG 6

SYSTEM FOR HANGING A LAMP

BACKGROUND OF THE INVENTION

1. Field of the Invention

The present invention relates to a system for hanging a lamp and more particularly pertains to positioning a hanging lamp at any one of a plurality of locations with respect to a fixed electrical box in the ceiling.

2. Description of the Prior Art

The use of hanging systems for lamps of known designs and configurations is known in the prior art. More specifically, hanging systems for lamps of known designs and configurations previously devised and utilized for the purpose of suspending lamps from ceiling at any of a plurality of positions are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 3,561,719 to Grindle discloses a light fixture support. U.S. Pat. No. 3,589,660 to Dunckel discloses a lighting fixture hanger. U.S. Pat. No. 3,597,889 to Lo Nigro discloses a junction box suspension unit for suspended ceilings. U.S. Pat. No. 3,714,744 to Koziarz discloses an electrical fixture hanger. U.S. Pat. No. 4,114,327 to Williams discloses a light fixture support. U.S. Pat. No. 5,085,393 to Ryan discloses a hanger assembly method and apparatus. U.S. Pat. No. 5,393,026 to Dschamps et al. discloses an electrical fixture hanger. U.S. Pat. No. 4,695,114 to Stanton et al. discloses a lighting fixture. U.S. Pat. No. 5,282,600 to Weiss et al. discloses a universal quick connect hanger for suspending a lighting system. U.S. Pat. No. 5,588,737 to Kusmer discloses a modular recessed lighting system. U.S. Pat. No. 5,606,147 to Deschamps et al discloses an electrical outlet box for hanging an electrical fixture. U.S. Pat. No. 5,408,394 to Mandy discloses down lighting systems and fixtures thereof. Lastly, U.S. Pat. No. 5,939,671 to Gretz discloses a ceiling medallion assembly.

While these devices fulfill their respective, particular objectives and requirements, the aforementioned patents do not describe a system for hanging a lamp that allows positioning a hanging lamp at any one of a plurality of locations with respect to a fixed electrical box in the ceiling.

In this respect, the system for hanging a lamp according to the present invention substantially departs from the conventional concepts and designs of the prior art, and in doing so provides an apparatus primarily developed for the purpose of positioning a hanging lamp at any one of a plurality of locations with respect to a fixed electrical box in the ceiling.

Therefore, it can be appreciated that there exists a continuing need for a new and improved system for hanging a lamp which can be adjustably positioned in a convenient manner. In this regard, the present invention substantially fulfills this need.

SUMMARY OF THE INVENTION

In view of the foregoing disadvantages inherent in the known types of hanging systems for lamps of known designs and configurations now present in the prior art, the present invention provides an improved system for hanging a lamp. As such, the general purpose of the present invention, which will be described subsequently in greater detail, is to provide a new and improved system for hanging a lamp and method which has all the advantages of the prior art and none of the disadvantages.

To attain this, the present invention essentially comprises a new and improved system for hanging a lamp from a ceiling at any of a plurality of location. The system includes an electrical box positioned at a fixed location in a ceiling. A fixed aperture in the box faces downwardly from the box and is in alignment with a fixed aperture in the ceiling. A mounting plate is next provided. The mounting plate is in a circular configuration and has an exterior diameter sufficiently large to cover and be positioned over the entire apertures of the box and ceiling. A circular central aperture is provided through the mounting plate and four holes are provided adjacent to the periphery. Four short screws extend through the mounting plate adjacent to the periphery and into the ceiling. In this manner the mounting plate is secured with respect to the electrical box.

Next provided is a slip plate. The slip plate is formed in a circular configuration and has a large exterior diameter, about three times greater than the diameter of the mounting plate. The slip plate is formed with a slot. The slot extends through the slip plate along the majority of one diametric extent. The slot has a small width essentially equal to the diameter of the central aperture of the mounting plate and a length slightly less than the exterior diameter of the slip plate. A small washer is next provided. The small washer is fabricated of an elastomeric material and is located between the slip plate and the mounting plate. The washer has an exterior diameter less than that of the mounting plate. A central aperture is provided through the washer essentially equal to the diameter of the central aperture of the mounting plate and the width of the slot. Next provided is a flanged cylinder. The flanged cylinder has a cylindrical central extent with a length essentially equal to the total combined thickness of the mounting plate, washer, and slide plate. The flanged cylinder extends through the mounting plate, washer and slide plate. The flanged cylinder has a central bore for the passage of electrical wires from the box to a supported lamp. The flanged cylinder also has a flanged interior upper end located above and in contact with the mounting plate. The cylinder also has a flanged exterior end in contact with the slip plate. The flanged cylinder is adapted to allow the slip plate to be moved linearly with respect to the mounting plate and box and also to be rotated with respect to the mounting plate and box. Lastly, a medallion cover is provided. The cover is in a circular configuration with an exterior diameter greater than that of the slip plate and positionable in contact with the ceiling. The cover has an intermediate internal shoulder for removably receiving the periphery of the slip plate for a snap-on removably coupling with respect thereto. The cover also has a central aperture with internal threads for supporting a lamp there beneath.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved system for hanging a lamp which has all of the advantages of the prior art hanging systems for lamps of known designs and configurations and none of the disadvantages.

It is another object of the present invention to provide a new and improved system for hanging a lamp which may be easily and efficiently manufactured and marketed.

It is further object of the present invention to provide a new and improved system for hanging a lamp which is of durable and reliable constructions.

An even further object of the present invention is to provide a new and improved system for hanging a lamp which is susceptible of a low cost of manufacture with regard to both materials and labor, and which accordingly is then susceptible of low prices of sale to the consuming public, thereby making such system for hanging a lamp economically available to the buying public.

Even still another object of the present invention is to provide a system for hanging a lamp for positioning a hanging lamp at any one of a plurality of locations with respect to a fixed electrical box in the ceiling.

Lastly, it is an object of the present invention to provide a new and improved system for hanging a lamp at any of a plurality of locations includes an electrical box positioned at a fixed location in a ceiling. A mounting plate has an exterior periphery with a circular central aperture there through and with holes adapted to the periphery and screws extending there through. A slip plate has a large exterior diameter greater than the diameter of the mounting plate. The slip plate is formed with a slot along the majority of one diametric extent. A small washer located between the slip plate and the mounting plate has a central aperture there through essentially equal to the diameter of the central aperture of the mounting plate and the width of the slot. A flanged cylinder has a cylindrical central extent, a central bore, a flanged interior upper end located above and in contact with the mounting plate, and a flanged exterior end in contact with the slip plate. A medallion cover has an exterior diameter greater than that of the slip plate and is positionable in contact with the ceiling.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 2.

FIG. 4 is a cross sectional view taken along line 4—4 of FIG. 3.

FIG. 5 is a perspective view of the system shown in the prior figures in anticipation of receiving a lamp to be hung therefrom.

FIG. 6 is a perspective view similar to FIG. 5 but illustrating an alternate embodiment of the invention with a rectangular slip plate and medallion cover.

The same reference numerals refer to the same parts throughout the various Figures.

DESCRIPTION OF THE PREFERRED EMBODIMENT

Figure 1:
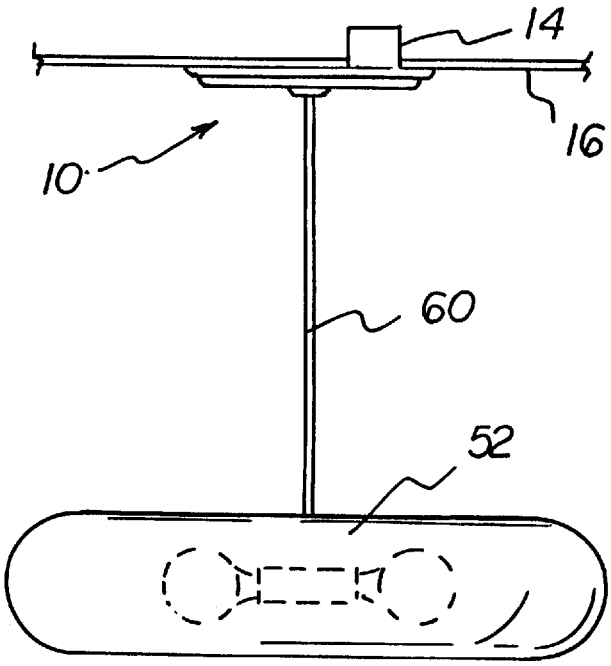
FIG. 1 is a front elevational illustration of the new and improved system for hanging a lamp constructed in accordance with the principles of the present invention.
Figure 2:
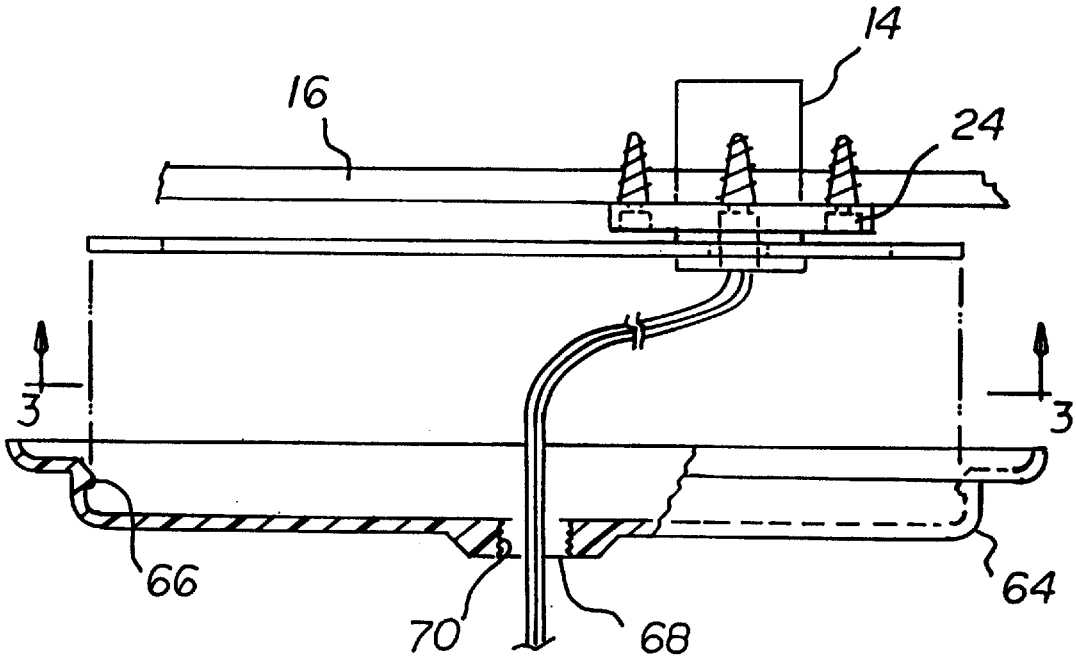
FIG. 2 is an enlarged cross sectional view, partially exploded, of the coupling components shown in the upper extent of FIG. 1.

With reference now to the drawings, and in particular to FIG. 1 thereof, the preferred embodiment of the new and improved system for hanging a lamp embodying the principles and concepts of the present invention and generally designated by the reference numeral 10 will be described.

The present invention, the system 10 for hanging a lamp is comprised of a plurality of components. Such components in their broadest context include an electrical box, a mounting box, a mounting plate, a slip plate, a small washer, a flanged cylinder, and a medallion cover. Such components are individually configured and correlated with respect to each other so as to attain the desired objective.

First provided is an electrical box 14 positioned at a fixed location in a ceiling 16. A fixed aperture 18 in the box faces downwardly from the box and is in alignment with a fixed aperture 20 in the ceiling.

A mounting plate 24 is next provided. The mounting plate is in a circular configuration and has an exterior diameter sufficiently large to cover and be positioned over the entire apertures of the box and ceiling. A circular central aperture 26 is provided through the mounting plate and four holes 28 are provided adjacent to the periphery. Four short screws 30 extend through the mounting plate adjacent to the periphery and into the ceiling. In this manner the mounting plate is secured with respect to the box.

Next provided is a slip plate 34. The slip plate is formed in a circular configuration and has a large exterior diameter, about 3 times greater than the diameter of the mounting plate. The slip plate is formed with a slot 36. The slot extends through the slip plate along the majority of one diametric extent. The slot has a small width essentially equal to the diameter of the central aperture of the mounting plate and a length slightly less than the exterior diameter of the slip plate.

A small washer 40 is next provided. The small washer is fabricated of an elastomeric material and is located between the slip plate and the mounting plate. The washer has an exterior diameter less than that of the mounting plate. A central aperture 42 is provided through the washer essentially equal to the diameter of the central aperture of the mounting plate and the width of the slot.

Next provided is a flanged cylinder 46. The flanged cylinder has a cylindrical central extent 48 with a length essentially equal to the total combined thickness of the mounting plate, washer, and slide plate. The flanged cylinder extends through the mounting plate, washer and slide plate. The flanged cylinder has a central bore 50 for the passage of electrical wires from the box to a supported lamp 52. The flanged cylinder also has a flanged interior upper end 54 located above and in contact with the mounting plate. The flanged cylinder also has a flanged exterior end 56 in contact with the slip plate. The flanged cylinder is adapted to allow the slip plate to be moved linearly with respect to the mounting plate and box and also to be rotated with respect to the mounting plate and box.

Lastly, a medallion cover 64 is provided. The cover is in a circular configuration with an exterior diameter greater than that of the slip plate and positionable in contact with the ceiling. The cover has an intermediate internal shoulder 66 for receiving the periphery of the slip plate. The cover also has a central aperture 68 with threads 70 for receiving the support rod 60 of the lamp.

An alternate embodiment of the invention is shown in FIG. 6. In such embodiment, most of the elements are constructed as in the primary embodiment. In such alternate embodiment, the slip plate 34 of the primary embodiment is replaced by a rectangular slip plate 72. It is formed with a slot 74 similar to that of the primary embodiment. Further, in this alternate embodiment, the circular medallion cover 60 is replaced by a rectangular medallion cover 76 with a rectangular shoulder 78 for a snap-on removable reception of the periphery of the rectangular slip plate. The remaining components of the system function as in the primary embodiment.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved system for hanging a lamp from a ceiling at any of a plurality of locations comprising, in combination:

an electrical box positioned at a fixed location in a ceiling, the box including a fixed aperture facing downwardly therefrom in alignment with a fixed aperture in the ceiling;

a mounting plate in a circular configuration having an exterior diameter sufficiently large to cover the entire apertures of the box and ceiling and positioned there over and with a circular central aperture there through and with four holes adjacent to the periphery and four short screws extending through the mounting plate adjacent to the periphery and into the ceiling for securing the mounting plate with respect to the box;

a slip plate in a circular configuration having a large exterior diameter, about 3 times greater than the diameter of the mounting plate, the slip plate being formed with a peripheral edge and a slot extending there through along the majority of one diametric extent, the slot having a small width essentially equal to the diameter of the central aperture of the mounting plate and of a length slightly less than the exterior diameter of the slip plate;

a small washer fabricated of an elastomeric material located between the slip plate and the mounting plate, the washer having an exterior diameter less than that of the mounting plate with a central aperture there through essentially equal to the diameter of the central aperture of the mounting plate and the width of the slot;

a flanged cylinder having a cylindrical central extent with a length essentially equal to the total combined thickness of the mounting plate, washer, and slide plate, with the flanged cylinder extending there through, the flanged cylinder having a central bore for the passage of electrical wires from the box to a supported lamp, the flanged cylinder also having a flanged interior upper end located above and in contact with the mounting plate and a flanged exterior end in contact with the slip plate, the flanged cylinder adapted to allow the slip plate to be moved linear with respect to the mounting plate and box and also to be rotated with respect thereto; and a medallion cover in a circular configuration with an exterior diameter greater than that of the slip plate and positionable in contact with the ceiling, an intermediate internal shoulder for removably supporting the peripheral edge of the slip plate and a central aperture with internal threads for supporting a lamp there beneath.

2. A system for hanging a lamp from a ceiling at any of a plurality of locations comprising:

an electrical box positioned at a fixed location in a ceiling;

a mounting plate having an exterior periphery with a circular central aperture there through and with holes adapted to the periphery and screws extending there through;

a slip plate having a large exterior diameter greater than the diameter of the mounting plate, the slip plate being formed with a peripheral edge and with a slot along the majority of one diametric extent;

a small washer located between the slip plate and the mounting plate, the washer having a central aperture there through essentially equal to the diameter of the central aperture of the mounting plate and the width of the slot;

a flanged cylinder having a cylindrical central extent, the flanged cylinder having a central bore and a flanged interior upper end located above and in contact with the mounting plate and a flanged exterior end in contact with the slip plate; and a medallion cover with an exterior diameter greater than that of the slip plate and positionable in contact with the ceiling, the medallion cover being removably coupled to the slip plate.

3. The system as set forth in claim 2 wherein the slip plate and medallion cover are round.

4. The system as set forth in claim 2 wherein the slip plate and medallion cover are rectangular.

5. The system as set forth in claim 2 wherein the medallion cover includes an intermediate shoulder for supporting the peripheral edge of the slip plate in the central aperture with internal threads for supporting a lamp there beneath.

* * * * *